US010125524B2

(12) United States Patent
Kouzuma et al.

(10) Patent No.: US 10,125,524 B2
(45) Date of Patent: Nov. 13, 2018

(54) VEHICLE DOOR LATCH CONTROL DEVICE

(71) Applicant: KABUSHIKI KAISHA HONDA LOCK, Miyazaki-Shi, Miyazaki (JP)

(72) Inventors: Hiroyuki Kouzuma, Miyazaki (JP); Kazuyuki Kuriyama, Miyazaki (JP)

(73) Assignee: Kabushiki Kaisha Honda Lock, Miyazaki (JP)

( * ) Notice: Subject to any disclaimer, the term of this patent is extended or adjusted under 35 U.S.C. 154(b) by 386 days.

(21) Appl. No.: 14/786,262

(22) PCT Filed: Mar. 31, 2014

(86) PCT No.: PCT/JP2014/059467

§ 371 (c)(1),
(2) Date: Oct. 22, 2015

(87) PCT Pub. No.: WO2014/175007

PCT Pub. Date: Oct. 30, 2014

(65) Prior Publication Data

US 2016/0076277 A1 Mar. 17, 2016

(30) Foreign Application Priority Data

Apr. 25, 2013 (JP) ..... 2013-092914

(51) Int. Cl.
*E05B 81/16* (2014.01)
*E05B 81/68* (2014.01)
(Continued)

(52) U.S. Cl.
CPC ..... *E05B 81/16* (2013.01); *E05B 41/00* (2013.01); *E05B 81/14* (2013.01); *E05B 81/54* (2013.01);
(Continued)

(58) Field of Classification Search
CPC ..... E05B 81/68; E05B 81/66; E05B 81/64; E05B 2047/0067; E05B 81/74; Y10T 70/5978
(Continued)

(56) References Cited

U.S. PATENT DOCUMENTS 6,848,727 B1 * 2/2005 Cetnar ..... E05B 81/20 292/201
7,380,845 B2 6/2008 Suzumura et al.
(Continued)

FOREIGN PATENT DOCUMENTS

CN 1824913 A 8/2006
CN 1904298 A 1/2007
(Continued)

OTHER PUBLICATIONS

Official Communication dated Oct. 18, 2016 to corresponding Chinese Patent Application No. 201480023310.3.

*Primary Examiner* — Mark A Williams
(74) *Attorney, Agent, or Firm* — Carrier Blackman & Associates, P.C.; William D. Blackman; Joseph P. Carrier

(57) ABSTRACT

A vehicle door latch control device is provided in which power from an electric actuator controlled by a control unit is transmitted via transmission means to a ratchet that can engage with a latch that engages with a striker on a vehicle body side and pivots, wherein a first switch detects whether the ratchet is in a ratchet engagement position, a second switch detects that the transmission means has operated until the ratchet attains the ratchet engagement position based on an operating position of an operating member forming part of the transmission means, and the control unit that controls actuation of the electric actuator determines that there is an abnormal state when the switching mode of the first switch is unchanged at the time the second switch changes switch-
(Continued)

ing mode. This enables an abnormal state in which engagement of a ratchet with a latch becomes insufficient.

4 Claims, 15 Drawing Sheets

(51) Int. Cl.

| | |
|---|---|
| ***E05B 81/14*** | (2014.01) |
| ***E05B 81/54*** | (2014.01) |
| ***E05B 41/00*** | (2006.01) |
| ***E05B 81/58*** | (2014.01) |
| ***E05C 3/12*** | (2006.01) |
| *E05B 85/26* | (2014.01) |
| *E05B 79/20* | (2014.01) |
| *E05B 81/06* | (2014.01) |
| *E05B 81/66* | (2014.01) |
| *E05B 81/64* | (2014.01) |
| *E05B 83/36* | (2014.01) |
| *E05B 81/76* | (2014.01) |
| *E05B 81/78* | (2014.01) |
| *E05B 85/12* | (2014.01) |
| *E05B 17/10* | (2006.01) |

(52) U.S. Cl.
CPC ..... *E05B 81/58* (2013.01); *E05B 81/68* (2013.01); *E05C 3/12* (2013.01); *E05B 17/10* (2013.01); *E05B 79/20* (2013.01); *E05B 81/06* (2013.01); *E05B 81/64* (2013.01); *E05B 81/66* (2013.01); *E05B 81/76* (2013.01); *E05B 81/78* (2013.01); *E05B 83/36* (2013.01); *E05B 85/12* (2013.01); *E05B 85/26* (2013.01)

(58) Field of Classification Search
USPC ..... 292/216
See application file for complete search history.

(56) References Cited

U.S. PATENT DOCUMENTS

| | | | | |
|---|---|---|---|---|
| 8,613,160 | B2 | 12/2013 | Matsumoto et al. | |
| 8,651,537 | B2 | 2/2014 | Imatomi et al. | |
| 2007/0046035 | A1 | 3/2007 | Tolley | |
| 2009/0151257 | A1* | 6/2009 | Dominique | E05B 81/20 49/280 |
| 2010/0244466 | A1* | 9/2010 | Tomaszewski | E05L 377/26 292/201 |
| 2011/0089705 | A1* | 4/2011 | Barth | E05B 85/243 292/226 |

FOREIGN PATENT DOCUMENTS

| | | | |
|---|---|---|---|
| CN | 101713268 | A | 5/2010 |
| CN | 102108813 | A | 6/2011 |
| JP | H01-163671 | U | 11/1989 |
| JP | 2006-009485 | A | 1/2006 |
| JP | 2013-144908 | A | 7/2013 |

* cited by examiner

VEHICLE DOOR LATCH CONTROL DEVICE

TECHNICAL FIELD

The present invention relates to a vehicle door latch control device that includes a latch that, in response to pivoting of a door to a closed side thereof, engages with a striker on a vehicle body side and pivots, a ratchet that operates between a ratchet engagement position in which engagement with the latch in a completely closed state and a half-shut state of the door is enabled and a ratchet release position in which engagement with the latch is released, an electric actuator that exerts power for driving the ratchet between the ratchet engagement position and the ratchet release position, transmission means that is provided between the electric actuator and the ratchet so as to put the ratchet in the ratchet release position in a mode in which the electric actuator is not being actuated, and a control unit that controls actuation of the electric actuator.

BACKGROUND ART

A vehicle door latch control device that includes a latch that engages a striker on the vehicle body side in a door fully closed state, a pawl (corresponding to the ratchet of the invention of the present application) that operates between an engagement position in which it engages with the latch and an engagement release position in which engagement with the latch is released, an electric actuator that exerts power for driving the pawl, transmission means that transmits power from the electric actuator to the pawl, and a switch that detects that the pawl is in the engagement release position is known from Patent Document 1.

RELATED ART DOCUMENTS

Patent Documents

Patent Document 1: Japanese Utility Model Application Laid-open No. 1-163671

SUMMARY OF THE INVENTION

Problems to be Solved by the Invention

When the ratchet (pawl) moves from the ratchet release position to the ratchet engagement position, there is a possibility that due to a malfunction caused by deterioration of the transmission means or the ratchet the ratchet will stop before fully reaching the ratchet engagement position, and in this case engagement of the ratchet with the latch becomes insufficient when the door is closed, thus giving the problem that the door cannot be maintained in a fully closed state; it is conceivable that there is a possibility that engagement of the ratchet with the latch will be released due to vibration while the vehicle is traveling, but such an abnormal state cannot be detected by the arrangement disclosed in Patent Document 1 above.

The present invention has been accomplished in light of such circumstances, and it is an object thereof to provide a vehicle door latch control device that enables an abnormal state in which engagement of a ratchet with a latch becomes insufficient when a door is closed to be detected when such an abnormal state occurs.

Means for Solving the Problems

In order to attain the above object, according to a first aspect of the present invention, there is provided a vehicle door latch control device comprising a latch that, in response to pivoting of a door to a closed side thereof, engages with a striker on a vehicle body side and pivots, a ratchet that operates between a ratchet engagement position in which engagement with the latch in a completely closed state and a half-shut state of the door is enabled and a ratchet release position in which engagement with the latch is released, an electric actuator that exerts power for driving the ratchet between the ratchet engagement position and the ratchet release position, transmission means that is provided between the electric actuator and the ratchet so as to put the ratchet in the ratchet release position in a mode in which the electric actuator is not being actuated, and a control unit that controls actuation of the electric actuator, characterized in that the device comprises a first switch that detects whether or not the ratchet is in a ratchet engagement position, and a second switch that is provided separately from the first switch and that detects that the transmission means has operated until the ratchet attains the ratchet engagement position based on an operating position of an operating member forming part of the transmission means, and the control unit determines that there is an abnormal state when the switching mode of the first switch is unchanged at the time the second switch changes switching mode.

Further, according to a second aspect of the present invention, in addition to the first aspect, the device comprises a third switch that is provided separately from the first and second switches and that detects that the transmission means has operated until the ratchet attains the ratchet release position based on the operating position of the operating member, and the control unit determines that the first switch has failed when the first switch is in a switching mode showing that the ratchet is in the ratchet engagement position state at the time the third switch changes switching mode.

Furthermore, according to a third aspect of the present invention, in addition to the first or second aspect, the device comprises abnormality notification means that carries out notification in response to the control unit determining that there is said abnormal state.

A latch release electric motor 24 of an embodiment corresponds to the electric actuator of the present invention, a ratchet switch 51 of the embodiment corresponds to the first switch of the present invention, a cam 71 of the embodiment corresponds to the operating member of the present invention, an initial position cam switch 120 of the embodiment corresponds to the second switch of the present invention, a ratchet release position cam switch 121 of the embodiment corresponds to the third switch of the present invention, a latch control unit 122 of the embodiment corresponds to the control unit of the present invention, and a warning light 140 of the embodiment corresponds to the notification means of the present invention.

Effects of the Invention

In accordance with the first aspect of the present invention, even though the switching mode of the second switch is changed by operation of the operating member forming part of the transmission means in response to the ratchet moving to the ratchet engagement position, if the switching mode of the first switch for detecting whether or not the ratchet is in the ratchet engagement position does not change, this suggests that a failure of the first switch, abnormal operation of the transmission means, or abnormal operation of the ratchet has occurred, and such an abnormal state can be determined by the control unit.

Furthermore, in accordance with the second aspect of the present invention, even though the switching mode of the third switch is changed by operation of the operating member forming part of the transmission means in response to the ratchet moving to the ratchet release position, if the switching mode of the first switch for detecting whether or not the ratchet is in the ratchet engagement position is that corresponding to the ratchet engagement position, this suggests that a failure of the first switch has occurred, and such an abnormal state can be determined by the control unit. Moreover, when the ratchet is driven so as to go from the ratchet engagement position through the ratchet release position and return to the ratchet engagement position, the switching mode of the third switch switches earlier than that of the second switch, and a failure of the first switch can be determined with an earlier timing than the time of switching of the switching mode of the second switch.

Furthermore, in accordance with the third aspect of the present invention, since the notification means carries out notification when an abnormal state is determined, it is possible to prevent the occurrence of a situation in which engagement of the ratchet with the latch is released due to vibration while the vehicle is traveling.

EXPLANATION OF REFERENCE NUMERALS AND SYMBOLS

Figure 1:
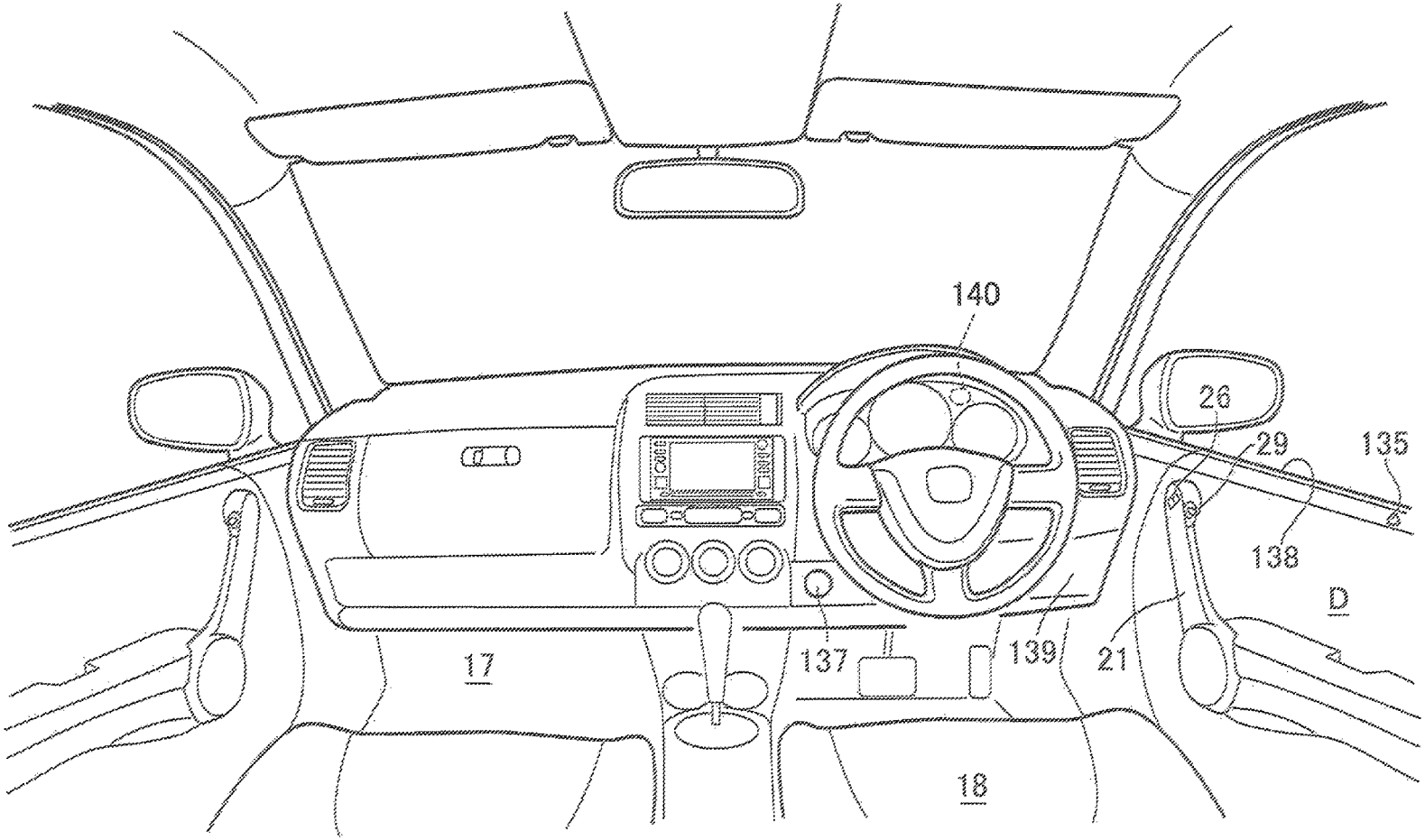
FIG. 1 is a view from the rear of a front part within a vehicle compartment of a passenger vehicle. (first embodiment)

24 Latch release electric motor which is an electric actuator
33 Striker
40 Latch
41 Ratchet
51 Ratchet switch which is a first switch
53 Transmission means
71 Cam which is an operating member
120 Initial position cam switch which is a second switch
121 Ratchet release position cam switch which is a third switch
122 Latch control unit which is a control unit
140 Warning light which is notification means
D Door

MODE FOR CARRYING OUT THE INVENTION

A mode for carrying out the present invention is explained below by reference to the attached FIG. 1 to FIG. 15.

First Embodiment

First, in FIG. 1, a driver's seat 18 is disposed on for example the front right side in the interior of a vehicle compartment 17 of a passenger vehicle, and an inside handle 21 is provided on an inner face of a front side door D on the driver's seat 18 side, the inside handle 21 being for a vehicle user on the driver's seat 18 to open and close the front side door D.

Figure 2:
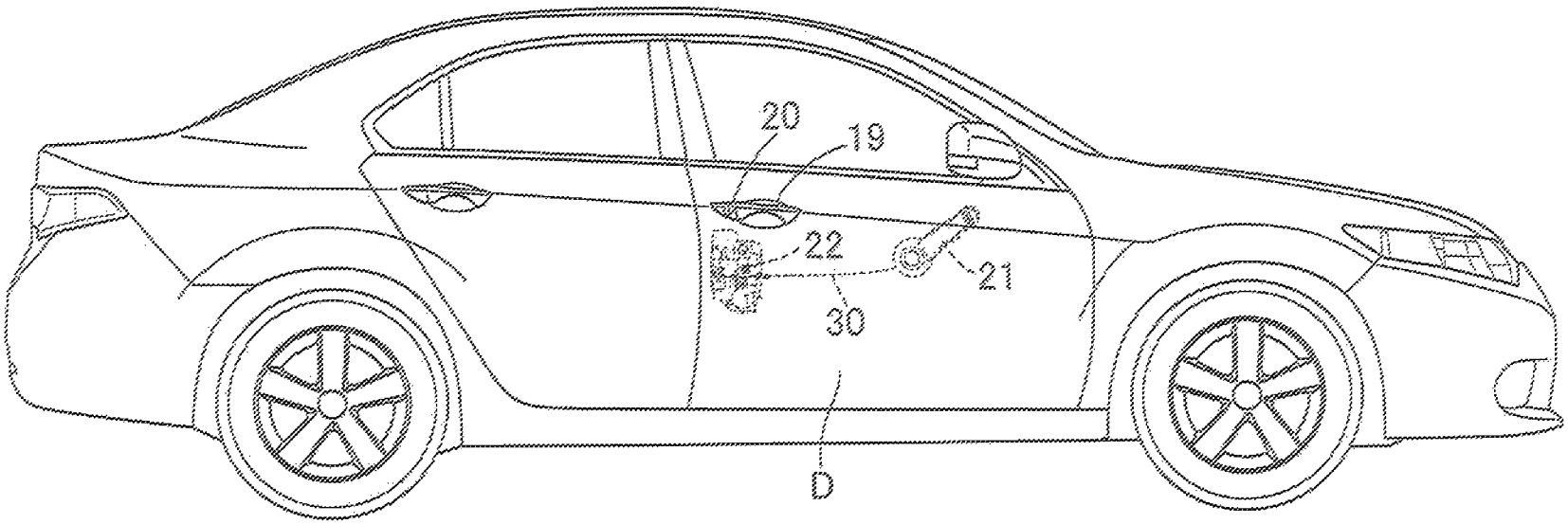
FIG. 2 is a right side view of the passenger vehicle. (first embodiment)

Referring in addition to FIG. 2, an outside handle 19 for opening and closing the front side door D is provided on an outer face of the front side door D on the driver's seat 18 side, and this outside handle 19 is equipped with a cylinder lock 20. Furthermore, a latch mechanism 22 is disposed on the front side door D of the driver's seat 18 side, the latch mechanism 22 being capable of switching between a latched state in which a closed state of the front side door D is maintained by engagement with the vehicle body side and an unlatched state in which opening of the front side door D is enabled.

Figure 3:
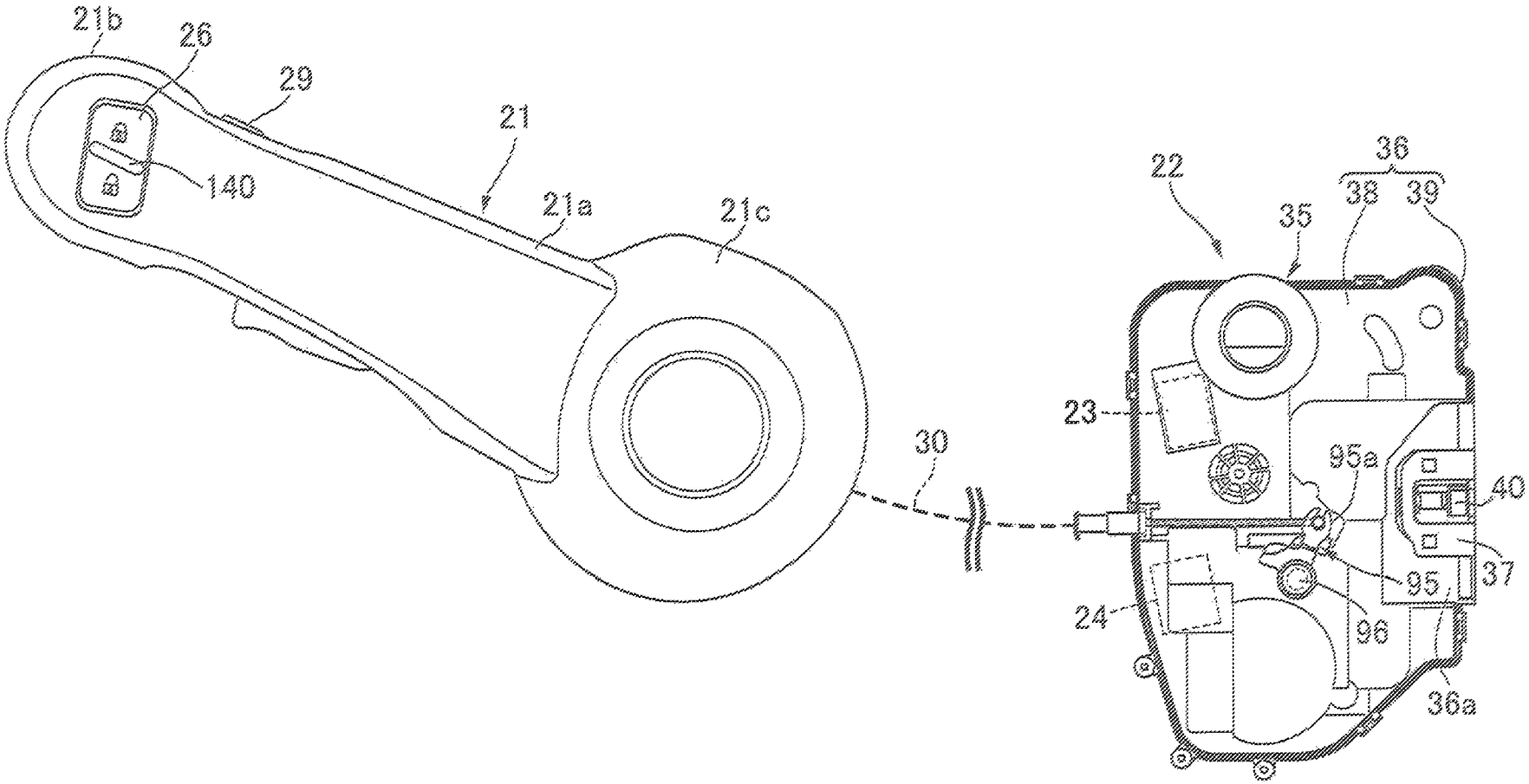
FIG. 3 is a side view from the vehicle compartment side of an inside handle and a latch mechanism of a front side door on a driver's seat side. (first embodiment)

In FIG. 3, the latch mechanism 22 includes a reversible lock/unlock switching electric motor 23 and a latch release electric motor 24, the lock/unlock switching electric motor 23 exerting power for switching between an unlocked state in which release of the latched state is enabled and a locked state in which release of the latched state is disabled, and the latch release electric motor 24 exerting power for releasing the latched state in the unlocked state.

The inside handle 21 is formed from a grip portion 21*a* extending lengthwise in the fore-and-aft direction of the vehicle, a circular front support portion 21*b* provided so as to be connected to the front end of the grip portion 21*a*, and a rear support portion 21*c* formed to be a larger circle than the front support portion 21*b* and provided so as to be connected to the rear end of the grip portion 21*a*, the front support portion 21*b* and the rear support portion 21*c* of the inside handle 21, which is inclined upward to the front, being fixed to the inner face side of the front side door D.

Disposed on a face of the front support portion 21*b* of the inside handle 21 that faces the interior of the vehicle compartment is a lock/unlock switching switch 26 for switching between the locked state and the unlocked state of the latch mechanisms 22 of all of the doors, including the front side door D.

Furthermore, a push button 29 is disposed on a front upper side of the grip portion 21*a* of the inside handle 21; the vehicle user may push in the push button 29 when actuating the latch release electric motor 24 of the latch mechanism 22, and a cable 30 that is pulled in response to the push button 29 being pushed in extends from the inside handle 21 to the latch mechanism 22 side.

Figure 4:
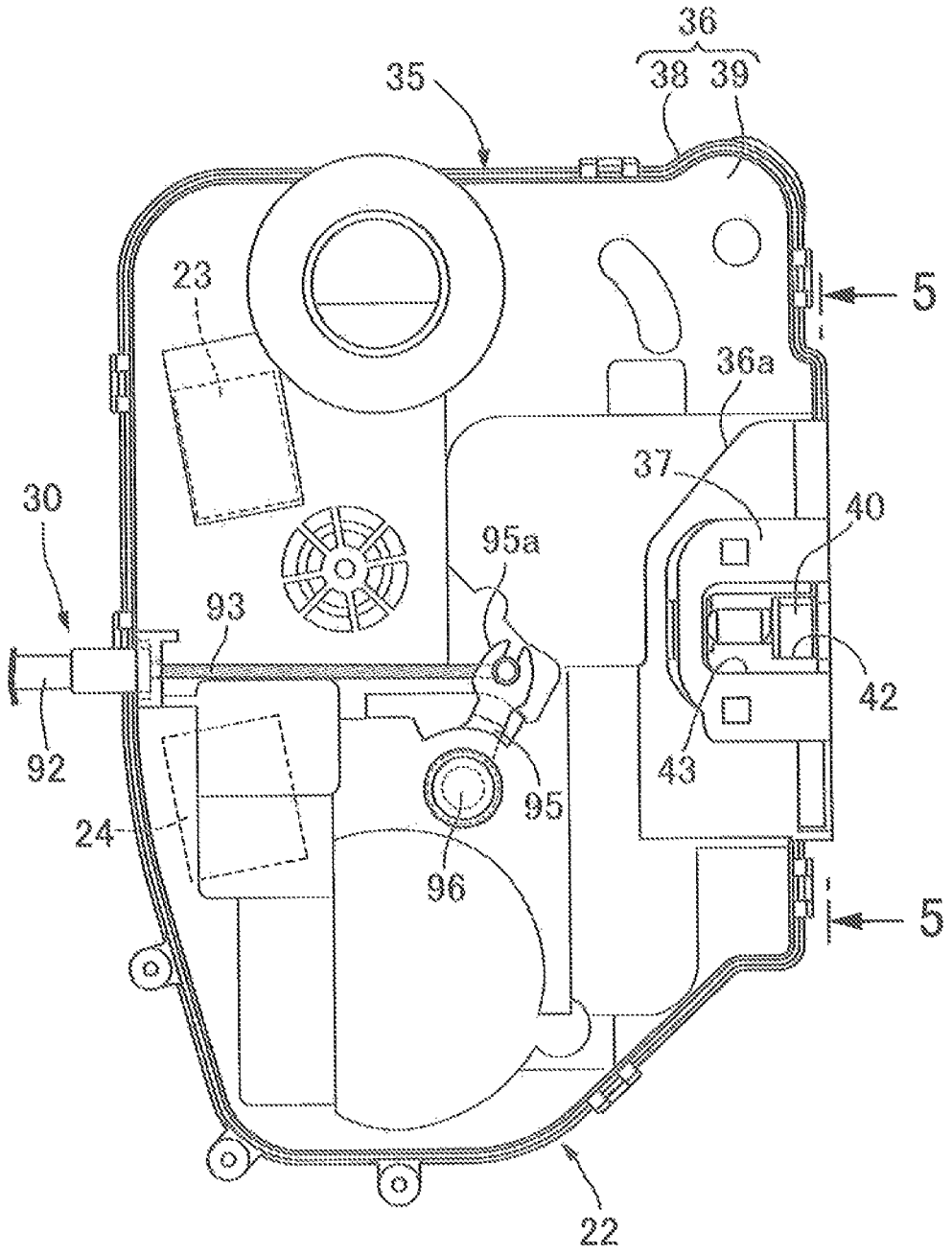
FIG. 4 is an enlarged side view of the latch mechanism. (first embodiment)

Referring in addition to FIG. 4, a casing 35 of the latch mechanism 22 has a housing case 36 that houses the lock/unlock switching electric motor 23 and the latch release electric motor 24, and a cover plate 37 that is made of metal and mounted on the housing case 36. The housing case 36 is formed from a case main body 38 that is formed from a synthetic resin into a box shape opening toward the vehicle compartment 17 side, and a cover member 39 that is made of a synthetic resin and detachably mounted on the case main body 38 so as to close the open end of the case main body 38; a projecting portion 36*a* is provided integrally with the housing case 36, the projecting portion 36*a* projecting toward the inner face side of the front side door D on the free end side of the front side door D, and the cover plate 37 is mounted on the projecting portion 36*a*.

Figure 5:
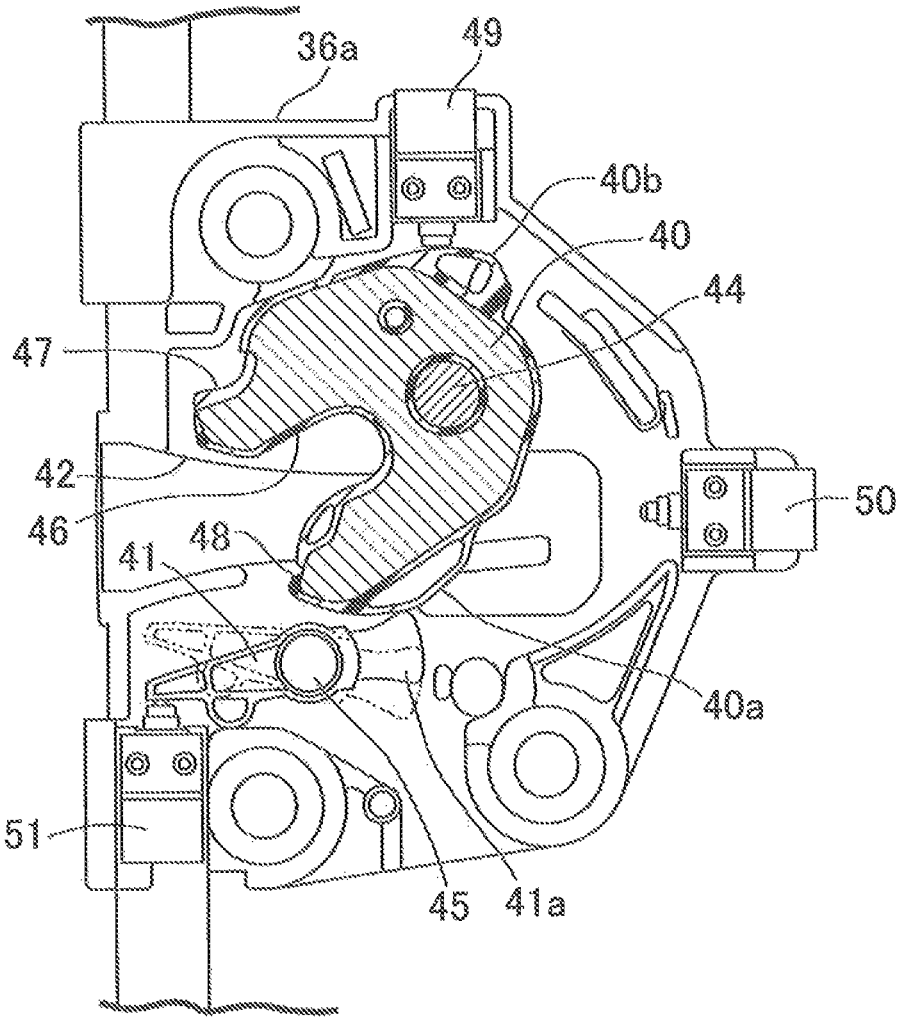
FIG. 5 is a view along line 5-5 in FIG. 4 in a door-opened state of part of the latch mechanism with a cover plate detached from a casing. (first embodiment)
Figure 6:
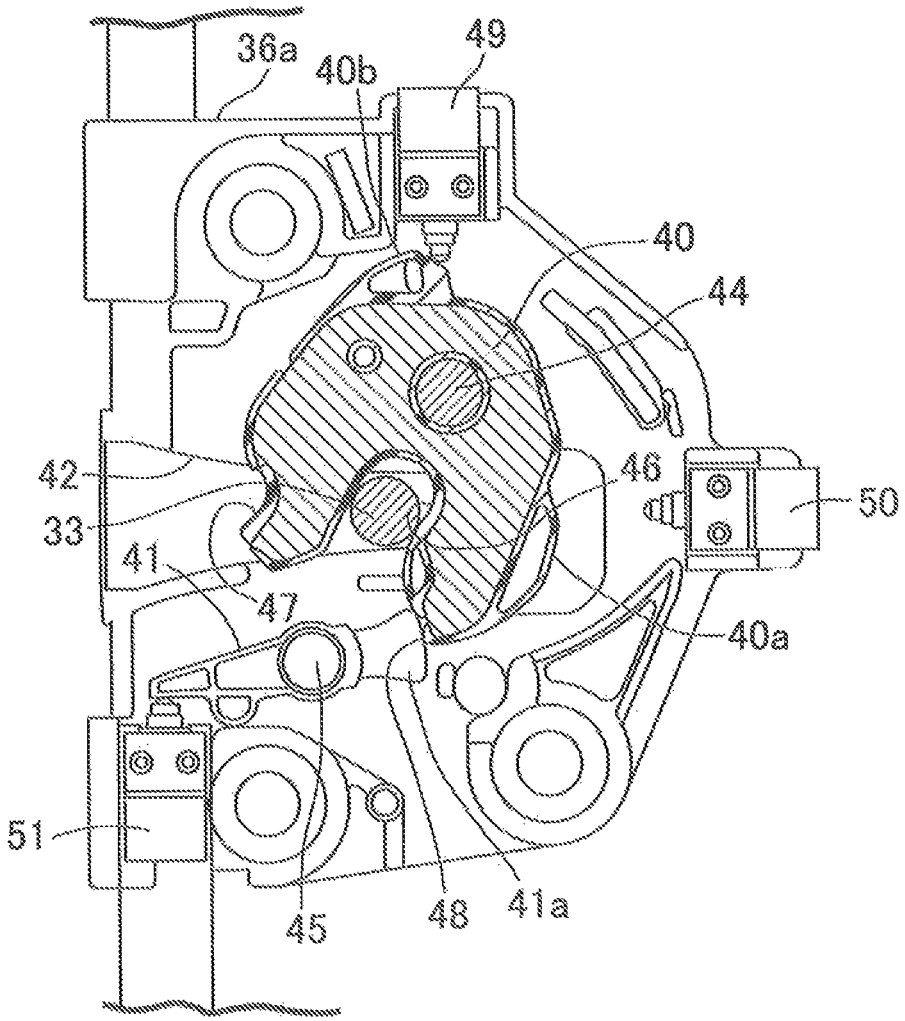
FIG. 6 is a view, corresponding to FIG. 5, in a half-shut state. (first embodiment)
Figure 7:
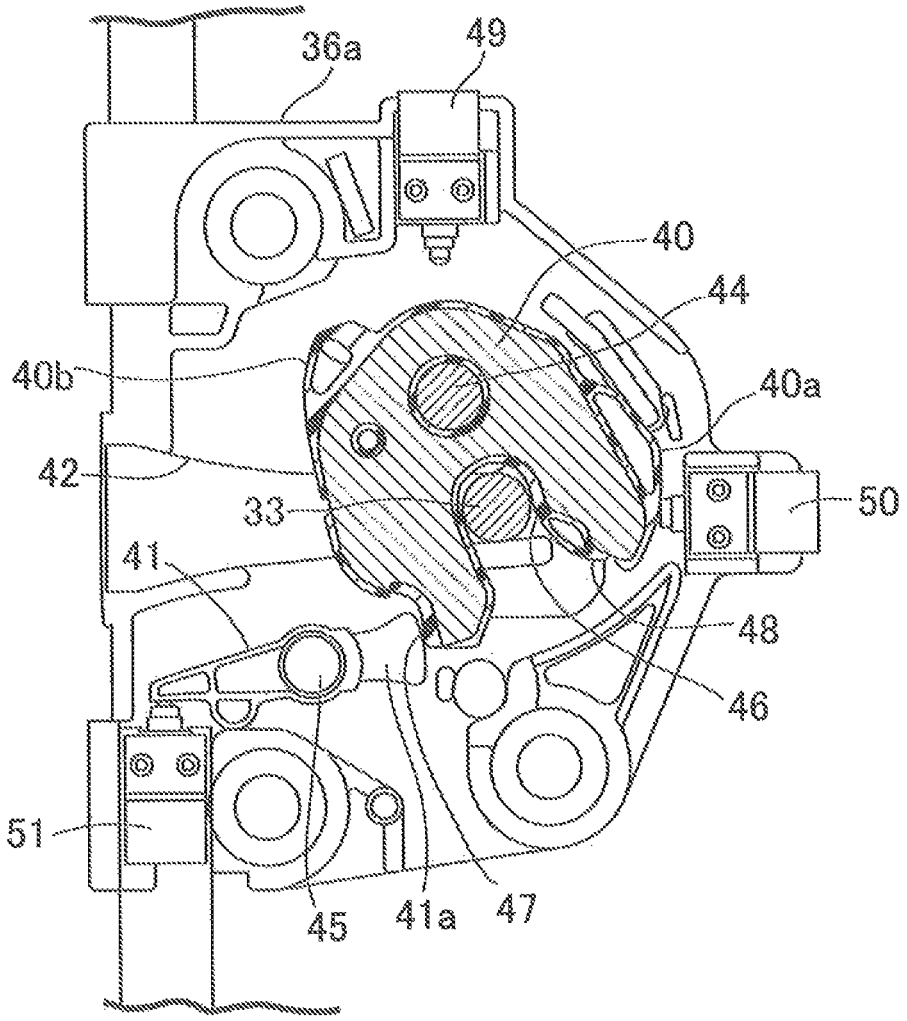
FIG. 7 is a view, corresponding to FIG. 5, in a fully-latched state. (first embodiment)

In FIG. 5, housed between the projecting portion 36*a* and the cover plate 37 are a latch 40 and a ratchet 41 that can engage with the latch 40 so as to maintain a pivoting position of the latch 40, the latch 40 being capable of pivoting in a door closing direction (the counterclockwise direction in FIG. 5) by engagement with a striker 33 fixed on the vehicle body side (see FIG. 6 and FIG. 7). Optionally, the ratchet 41 may alternatively be referred to as a ratchet pawl.

An approach groove 42 for the striker 33 to enter is formed in the projecting portion 36*a*, and an opening 43 corresponding to the approach groove 42 is provided in the cover plate 37. The latch 40 is pivotably supported by a first support shaft 44 provided between the cover plate 37 and the projecting portion 36*a*. Furthermore, a second support shaft 45 having an axis parallel to the first support shaft 44 is provided on the cover plate 37 and the projecting portion 36*a* at a position at which the approach groove 42 is present between the second support shaft 45 and the first support shaft 44, and the ratchet 41 is pivotably supported on the second support shaft 45.

The latch 40 is pivotingly urged in the door opening direction (the clockwise direction in FIG. 5) by means of a spring (not illustrated) provided in a compressed state between the latch 40 and the projecting portion 36*a*. Provided on an outer peripheral part of the latch 40 are an engagement groove 46, a full engagement step part 47, and a half engagement step part 48. The striker 33 entering the approach groove 42 engages with the engagement groove 46 when the latch 40 is present at the end of pivoting in the door opening direction.

On the other hand, the ratchet 41 is provided integrally with an engagement arm portion 41*a* projecting toward the latch 40 side so that the engagement arm portion 41*a* can engage with the full engagement step part 47 and the half engagement step part 48 of the latch 40. This ratchet 41 is pivoted by actuation of the latch release electric motor 24 between a ratchet engagement position shown by the solid line in FIG. 5 and a ratchet release position shown by the chain line in FIG. 5. Moreover, a ratchet lever 58 shown in FIG. 8 described below is operatively linked to the ratchet 41 so as to pivot together with the ratchet 41.

In a state in which the ratchet 41 is present at the ratchet engagement position, when the latch 40 is present at the end of pivoting in the door opening direction (the pivoting position shown in FIG. 5) the engagement arm portion 41*a* of the ratchet 41 is in contact with a first elastic bulge portion 40*a* provided on the outer periphery of the half engagement step part 48 of the latch 40; when the latch 40 is pushed by the striker 33 entering the approach groove 42 and pivots in the door closing direction (the counterclockwise direction in FIG. 5), as shown in FIG. 6 the striker 33 engages with the engagement groove 46 and the engagement arm portion 41*a* engages with the half engagement step part 48, thereby maintaining a half-shut state for the front side door D and attaining a half-latched state. Furthermore, when the latch 40 pivots further in the door closing direction in response to the striker 33 engaged with the engagement groove 46 entering further into the interior of the approach groove 42, as shown in FIG. 7 the ratchet 41 makes the engagement arm portion 41*a* engage with the full engagement step part 47, and the front side door D is locked in a completely door closed state, thus attaining a fully-latched state.

When the ratchet 41 is pivoted from the ratchet engagement position to the ratchet release position in the fully-latched state, the latch mechanism 22 attains an unlatched state, a waterproof seal present between the front side door D and the vehicle body when the door D is in a closed state exerts a reaction force to thus very slightly open the front side door D, and in response thereto the latch 40 also slightly pivots in the door opening direction; in response to an operating force in the opening direction being applied to the front side door D the striker 33 moves in the interior of the approach groove 42, and in response thereto the latch 40 pivots to the end of pivoting in the door opening direction shown in FIG. 5.

While the latch 40 is at a pivoting position from the end of pivoting in the door opening direction shown in FIG. 5 to immediately before the half-latched state shown in FIG. 6, that is, when a latched state of the front side door D is released and it is opened, an unlatched switch 49 that is mounted on the projecting portion 36*a* of the housing case 36 abuts against a second elastic bulge portion 40*b* provided on the outer periphery of the latch 40 and attains an ON state, and a fully-latched switch 50 that, when the latch 40 reaches the end of pivoting in the door closing direction as shown in FIG. 7, abuts against the first elastic bulge portion 40*a* on the outer periphery of the latch 40 and attains an ON state is also mounted on the projecting portion 36*a* of the housing case 36. Furthermore, mounted on the projecting portion 36*a* is a ratchet switch 51 that abuts against the ratchet 41 and attains an ON state in a state in which the ratchet 41 is at the ratchet engagement position.

Figure 8:
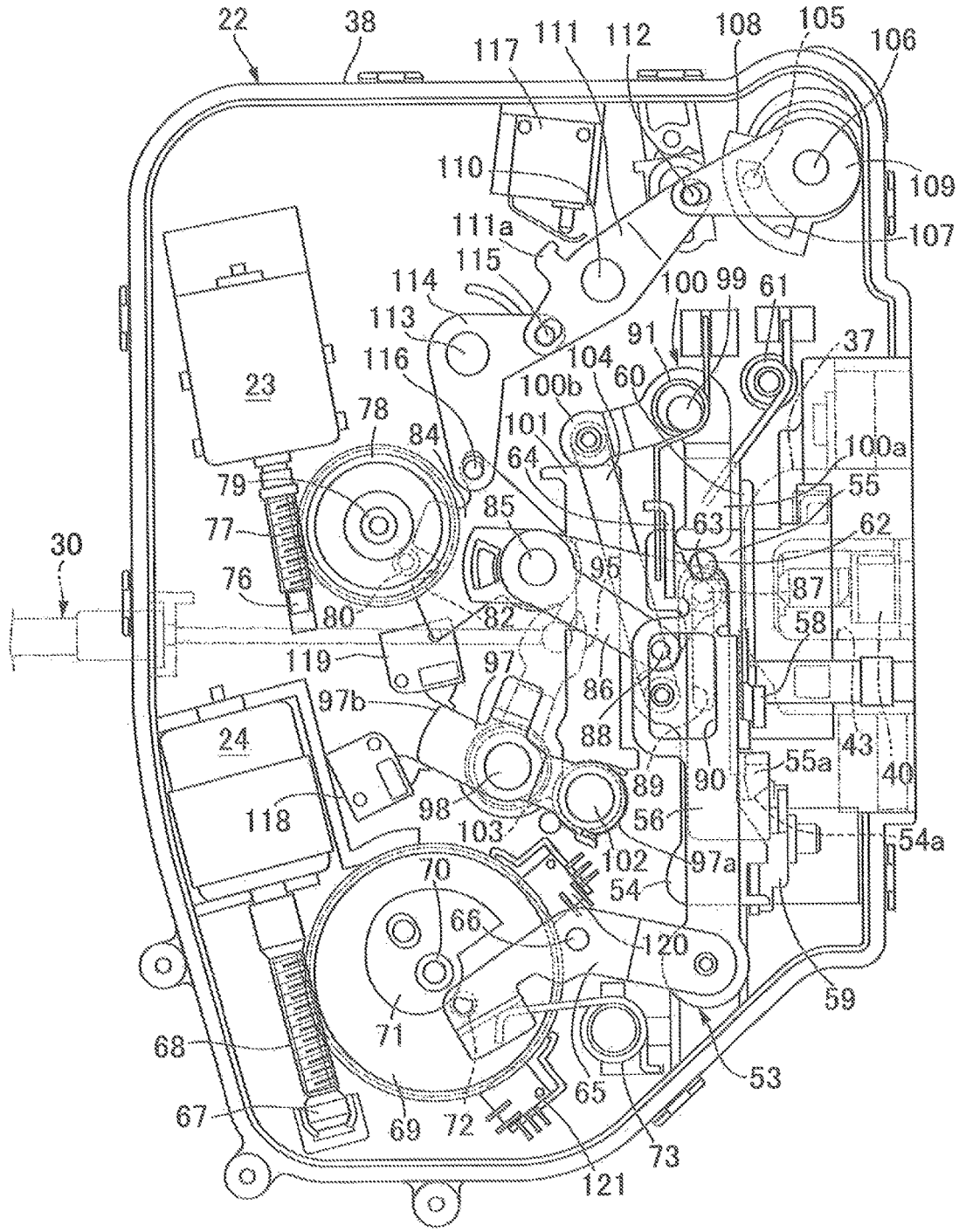
FIG. 8 is a side view of an essential part showing part of the latch mechanism in an unlocked state with a cover member and the cover plate detached from the casing. (first embodiment)

In FIG. 8, in an area close to the cover plate 37 within the case main body 38 in the housing case 36, an open link 54, a release link 55, and a first cancel lever 56 are disposed so as to be superimposed on one another in sequence from the side opposite to the cover member 39. When the open link 54 or the release link 55 moves upward while being in a vertically extending attitude and, from below, abuts against and engages with the ratchet lever 58, which pivots together with the ratchet 41, to thus pivot the ratchet lever 58, the ratchet 41 pivots from the ratchet engagement position to the ratchet release position, this allows the latch 41 to pivot in the door opening direction, and a latched state of the front side door D is released.

An open lever 59 is pivotably supported on a lower part of the cover plate 37 side of the case main body 38, the open lever 59 pivoting in response to operation of the outside handle 19 disposed on the outer face side of the front side door D, a lower end part of the open link 54 is linked to the open lever 59 so as to allow the open link 54 to pivot, and the open link 54 operates vertically in response to pivoting of the open lever 59. Moreover, provided on the open link 54 is a pressing portion 54*a* that can abut against and engage with the ratchet lever 58 from below when the open link 54 is in a vertically extending attitude as shown in FIG. 8.

Furthermore, the release link 55 is supported on the case main body 38 in a vertically operable manner, a guide wall 60 for guiding vertical movement of the release link 55 is provided on the case main body 38 so as to be disposed between the release link 55 and the cover plate 37, and a torsion spring 61 that urges the release link 55 toward the side on which it is put into sliding contact with the guide wall 60 is provided between the case main body 38 and the release link 55. Moreover, a link pin 62 is implanted in an upper part of the release link 55, and a pressing portion 55*a* that can abut against and engage with the ratchet lever 58 from below is provided on the release link 55.

Formed on an upper end part of the first cancel lever 56 is an abutment face 63 that can abut against the link pin 62 from below and from the side opposite to the guide wall 60, and provided on the upper end part of the first cancel lever 56 is a latching plate part 64 opposing the link pin 62 from the side opposite to the cover plate 37.

One end part of a release lever 65 is pivotably linked to a lower end part of the first cancel lever 56, and an intermediate part of the release lever 65 is pivotably supported on the case main body 38 via a third support shaft 66 so as to vertically operate the first cancel lever 56.

The latch release electric motor 24 is fixedly disposed on the case main body 38, and a worm wheel 69 meshing with a worm gear 68 provided on an output shaft 67 of the latch release electric motor 24 is pivotably supported on the case main body 38 via a fourth support shaft 70 having an axis parallel to the third support shaft 66. A cam 71 pivoting together with the worm wheel 69 is provided on the worm wheel 69, and a pin 72 in sliding contact with the cam 71 is implanted in the other end part of the release lever 65. Moreover, a torsion spring 73 pivotingly urging the release lever 65 in a direction that puts the pin 72 into sliding contact with the cam 71 is provided between the case main body 38 and the release lever 65.

When the latch release electric motor 24 actuates so as to pivot the worm wheel 69 and the cam 71 in the counterclockwise direction in FIG. 8, due to the pin 72 being in sliding contact with the cam 71 the release lever 65 pivots in the counterclockwise direction in FIG. 8, and the first cancel lever 56 is pushed upward. The cam 71 is formed such that the force pushing the first cancel lever 56 upward is released in response to the latch release electric motor 24 actuating so as to pivot the cam 71 further in the counterclockwise direction in FIG. 8 after the first cancel lever 56 is pushed upward, and the first cancel lever 56 accordingly descends downward.

That is, provided between the latch release electric motor 24 and the ratchet 41 is transmission means 53 including the worm gear 68, the worm wheel 69, the cam 71, the pin 72, the torsion spring 73, the release lever 65, the first cancel lever 56, the release link 55, the link pin 62, and the ratchet lever 58, this transmission means 53 pivoting the ratchet 41 between the ratchet engagement position and the ratchet release position in response to actuation of the latch release electric motor 24 while putting the ratchet 41 in the ratchet release position when the latch release electric motor 24 is not being actuated.

The lock/unlock switching electric motor 23 is fixedly disposed on an upper part of the case main body 38 above the latch release electric motor 24, and a worm wheel 78 meshing with a worm gear 77 provided on an output shaft 76 of the lock/unlock switching electric motor 23 is pivotably supported on the case main body 38 via a fifth support shaft 79 parallel to the fourth support shaft 70. An engagement projection 80 is provided on the worm wheel 78 so as to be offset from the central axis, a fan-shaped first locking lever 84 having on the outer periphery a latching recess part 82 that the engagement projection 80 can engage with is pivotably supported on the case main body 38 via a sixth support shaft 85 parallel to the fifth support shaft 79, and a second locking lever 86 pivoting together with the first locking lever 84 is also pivotably supported on the case main body 38 via the sixth support shaft 85.

Provided on the second locking lever 86 are a first pin 87 inserted through an elongated hole 89 provided in the open link 54 so as to extend in the vertical direction, and a second pin 88 inserted through a rectangular opening 90 provided in the first cancel lever 56. A torsion spring 91 is provided between the case main body 38 and the first cancel lever 56, the torsion spring 91 urging the first cancel lever 56 in the direction in which the side edge, on the side opposite to the cover plate 37, of the opening 90 abuts against the second pin 88.

When in an unlocked state in which latch release of the front side door D is enabled, the lock/unlock switching electric motor 23 stops after pivoting the worm wheel 78 having the engagement projection 80 engaged with the latching recess part 82 to the position shown in FIG. 8, and in this state the second locking lever 86 is in a state in which it has pivoted to the maximum in the counterclockwise direction in FIG. 8 around the axis of the sixth support shaft 85. This puts the open link 54 and the first cancel lever 56 into an attitude in which they extend vertically as shown in FIG. 8, the abutment face 63 on the upper end part of the first cancel lever 56 can abut against the link pin 62 from below and push it upward, and the pressing portion 54*a* of the open link 54 can abut against the ratchet lever 58 from below.

Figure 9:
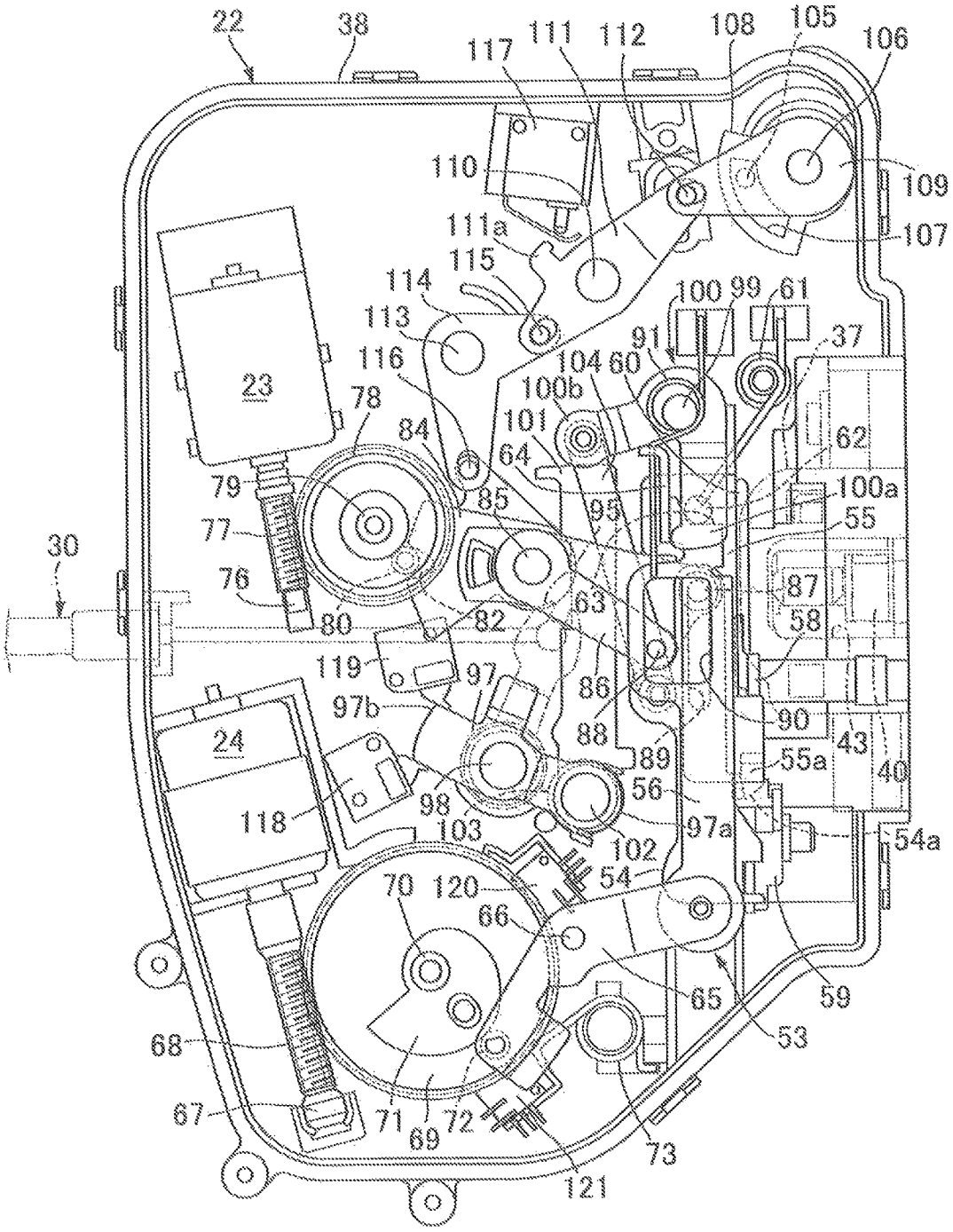
FIG. 9 is a side view, corresponding to FIG. 8, in a latch released state resulting from actuation of a latch release electric motor. (first embodiment)

When, in such an unlocked state, the first cancel lever 56 is pushed upward as shown in FIG. 9 by actuation of the latch release electric motor 24, the abutment face 63 on the upper end part of the first cancel lever 56 abuts against the link pin 62 of the release link 55 from below, in response to the first cancel lever 56 being pushed further upward the release link 55 is also pushed upward, the pressing portion 55*a* of the release link 55 abuts against the ratchet lever 58 from below so as to pivot the ratchet lever 58, and a latched state of the front side door D is released. Furthermore, when, in an unlocked state, the outside handle 19 disposed on the outer face side of the front side door D is operated so as to pivot the open lever 59, the open link 54 is pushed upward, the ratchet lever 58 is pivoted by the pressing portion 54*a* of the open link 54, and this also releases a latched state of the front side door D.

Figure 10:
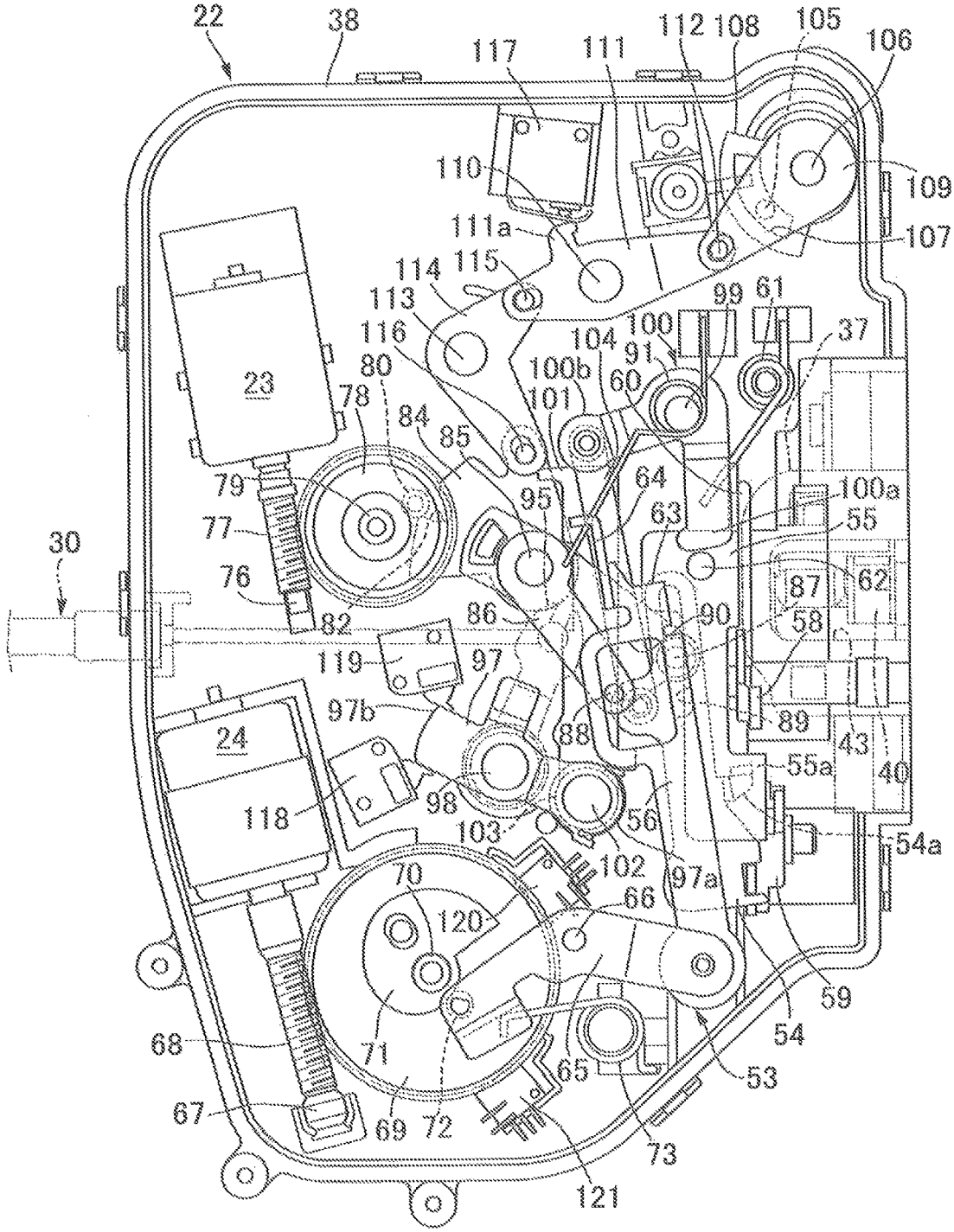
FIG. 10 is a side view, corresponding to FIG. 8, in a locked state. (first embodiment)

When attaining a locked state in which latch release of the front side door D is disabled even by actuation of the latch release electric motor 24 or operation of the outside handle 19, the lock/unlock switching electric motor 23 pivots the worm wheel 78 in the counterclockwise direction from the state of FIG. 8 and stops after pivoting the worm wheel 78 having the engagement projection 80 engaged with the latching recess part 82 to the position shown in FIG. 10, and in this state the second locking lever 86 is in a state in which it has pivoted to the maximum in the clockwise direction in FIG. 10 around the axis of the sixth support shaft 85. This puts the open link 54 and the first cancel lever 56 in an attitude in which they are inclined in a direction away from the guide wall 60 from the attitude in which they extend vertically. In this state, the abutment face 63 on the upper end part of the first cancel lever 56 does not abut against the link pin 62 from below even if the first cancel lever 56 moves upward, and the pressing portion 54*a* of the open link 54 is also at a position where it cannot abut against the ratchet lever 58 from below. Therefore, even if the first cancel lever 56 is pushed upward by actuation of the latch release electric motor 24, the release link 55 does not move upward, and even if the outside handle 19 is operated so as to move the open link 54 upward, the pressing portion 54*a* does not abut against the ratchet lever 58 from below, and the front side door D therefore remains in a latched state.

A first cylinder lever 108 pivoting in response to a key operation of the cylinder lock 20 attached to the outside handle 19 is supported on an upper part of the case main body 38 via a seventh support shaft 106, and an arc-shaped link hole 107 having the axis of the seventh support shaft 106 as its center is provided in the first cylinder lever 108. A second cylinder lever 109, which overlaps the first cylinder lever 108, is supported on the seventh support shaft 106 in a relatively pivotable manner with respect to the first cylinder lever 108, and a link pin 105 inserted through the link hole 107 is implanted in the second cylinder lever 109.

The second cylinder lever 109 is linked, via a link pin 112, to one end part of a third cylinder lever 111 pivotably supported on the case main body 38 via an eighth support shaft 110 having an axis parallel to the seventh support shaft 106. Furthermore, the other end part of the third cylinder lever 111 is linked, via a link pin 115, to one end part of a fourth cylinder lever 114 pivotably supported on the case main body 38 via a ninth support shaft 113 having an axis parallel to the eighth support shaft 110, and the other end part of the fourth cylinder lever 114 is linked to the first locking lever 84 via a link pin 116.

When, in the unlocked state, the cylinder lock 20 is operated toward the lock side, the first cylinder lever 108 pivots in the counterclockwise direction in FIG. 8, the second cylinder lever 109 pivots in the counterclockwise direction in response thereto, the third cylinder lever 111 pivots in the clockwise direction, and the fourth cylinder lever 114 pivots in the counterclockwise direction to thus pivot the first locking lever 84 in the counterclockwise direction to the position shown in FIG. 10. Furthermore, when, in the locked state, the cylinder lock 20 is operated to the unlock side, the first cylinder lever 108 pivots in the clockwise direction in FIG. 10, the second cylinder lever 109 pivots in the clockwise direction in response thereto, the third cylinder lever 111 pivots in the counterclockwise direction, and the fourth cylinder lever 114 pivots in the clockwise direction to thus pivot the first locking lever 84 in the clockwise direction to the position shown in FIG. 8.

The second to fourth cylinder levers 109, 111, and 114 are pivoted by actuation of the lock/unlock switching electric motor 23 in the same manner as when the cylinder lock 20 is operated, and a lock/unlock detection switch 117 for detecting if the latch mechanism 22 is in the unlocked state or the locked state is mounted on the case main body 38 such that its switching mode is changed by contact with and detachment from a detection portion 111*a* provided integrally with the third cylinder lever 111.

In FIG. 4, the cable 30, which transmits a mechanical force toward the latch mechanism 22 side in response to operation of the push button 29 disposed on the inside handle 21 of the front side door D, is formed by inserting an inner cable 93 into an outer cable 92, and an end part on the latch mechanism 22 side of the outer cable 92 is supported on the case main body 38 of the housing case 36.

A mechanical operating force input lever 95 to which a mechanical latch release operating force from the push button 29 of the inside handle 21 is transmitted is pivotably supported on the cover member 39 of the housing case 36 via a tenth support shaft 96.

The mechanical operating force input lever 95 integrally has a link arm portion 95*a*, an end part of the inner cable 93 projecting from the outer cable 92 being linked to an extremity of the link arm portion 95*a*, and the mechanical operating force input lever 95 is pivotably supported on the cover member 39 via the tenth support shaft 96 while the majority thereof, excluding the extremity of the link arm portion 95*a*, is disposed inside the cover member 39.

The extremity of the link arm portion 95*a* projects outwardly from the cover member 39, and the inner cable 93 is linked to the extremity of the link arm portion 95*a*. When the cable 30 is pulled in response to operation of the push button 29 disposed on the inside handle 21 of the front side door D, the mechanical operating force input lever 95 pivots around the axis of the tenth support shaft 96 in the counterclockwise direction in FIG. 4.

Referring again to FIG. 8 to FIG. 10, a latch release operating lever 97 that is operatively linked to the mechanical operating force input lever 95 and pivots together with the mechanical operating force input lever 95 is pivotably supported on the case main body 38 of the housing case 36 via an eleventh support shaft 98 coaxial with the tenth support shaft 96, and this latch release operating lever 97 is provided integrally with a link arm portion 97*a* linked to a lower end part of a vertically extending coupling link 101 via a link pin 102, and a detection arm portion 97*b* extending to the side opposite to the link arm portion 97*a*.

A torsion spring 103 is provided between the link arm portion 97*a* and the lower end part of the coupling link 101, the coupling link 101 is urged so as to pivot in the counterclockwise direction in FIG. 8 to FIG. 10 around the axis of the link pin 102, and the end of pivoting of the coupling link 101 in the direction in which it is pivotingly urged by the torsion spring 103 is restricted by it abutting against the first locking lever 84. Furthermore, the first locking lever 84 is operatively linked to an intermediate part of the coupling link 101 when the coupling link 101 moves upward from the lowest position only by a predetermined stroke, and when the coupling link 101 moves further upward, the first locking lever 84 and the second locking lever 86 are pivoted in the counterclockwise direction in FIG. 8 to FIG. 10.

A second cancel lever 100 is pivotably supported on the case main body 38 above the open link 54, the release link 55, and the first cancel lever 56 via a twelfth support shaft 99. This second cancel lever 100 integrally has a pressing arm portion 100*a* opposing the latching plate part 64 of the first cancel lever 56 from the guide wall 60 side, and a link arm portion 100*b* positioned above the coupling link 101, and an extremity of the link arm portion 100*b* and a longitudinally intermediate part of the open link 54 are linked via a cancel link 104. When the coupling link 101 is pushed upward, the upper end of the coupling link 101 abuts against the extremity of the link arm portion 100*b* of the second cancel lever 100 to thus push the link arm portion 100*b* upward, the latching plate part 64 is pushed by the pressing arm portion 100*a* to thus put the first cancel lever 56 in an inclined attitude, and the open link 54 is pulled upward.

A pair of latch release intention detection switches 118 and 119 are mounted on the latch mechanism 22, the latch release intention detection switches 118 and 119 detecting that the push button 29 disposed on the inside handle 21 of the front side door D has been operated and actuating the latch release electric motor 24.

The two latch release intention detection switches 118 and 119 detect the detection arm portion 97*b* of the latch release operating lever 97, which is operatively linked to the mechanical operating force input lever 95 linked to the cable 30 pulled by pushing the push button 29 of the inside handle 21 and pivots together with the mechanical operating force input lever 95; one latch release intention detection switch 118 is disposed at a position in which it is pushed by the detection arm portion 97*b* when the latch release operating lever 97 is pivoted by pushing the push button 29, and the other latch release intention detection switch 119 is disposed at a position in which it is not pushed by the detection arm portion 97*b* when the latch release operating lever 97 pivots but it is pushed by the detection arm portion 97*b* when the push button 29 is in a non-operated state and the latch release operating lever 97 does not pivot. That is, in a state in which one latch release intention detection switch 118 is in an ON state and the other latch release intention detection switch 119 is in an OFF state, it is confirmed that a vehicle driver has pushed the push button 29 in order to release the latched state.

When a single latch release intention detection switch is used, the switch could automatically turn ON due, for example, to a system failure, and the latch release electric motor 24 would be undesirably actuated, but providing two latch release intention detection switches 118 and 119 as described above for redundancy enables the occurrence of undesirable actuation of the latch release electric motor 24 to be prevented.

Furthermore, an initial position cam switch 120 and a ratchet release position cam switch 121 for detecting the pivoting position of the cam 71 together with the worm wheel 69 in response to actuation of the latch release electric motor 24 are mounted on the case main body 38 at positions around the worm wheel 69 with a gap therebetween. The initial position cam switch 120 is for determining the initial position of the latch release electric motor 24, and in a state in which the latch release electric motor 24 is at the initial position the ratchet 41 is at the ratchet engagement position. The ratchet release position cam switch 121 is disposed so as to detect a predetermined pivoting position for the cam 71 corresponding to the ratchet release position of the ratchet 41, in order that actuation of the latch release electric motor 24 is continued until the unlatched switch 49 detects an unlatched state when the latch release electric motor 24 is actuated so as to move the ratchet 41 to the ratchet release position.

Figure 11:
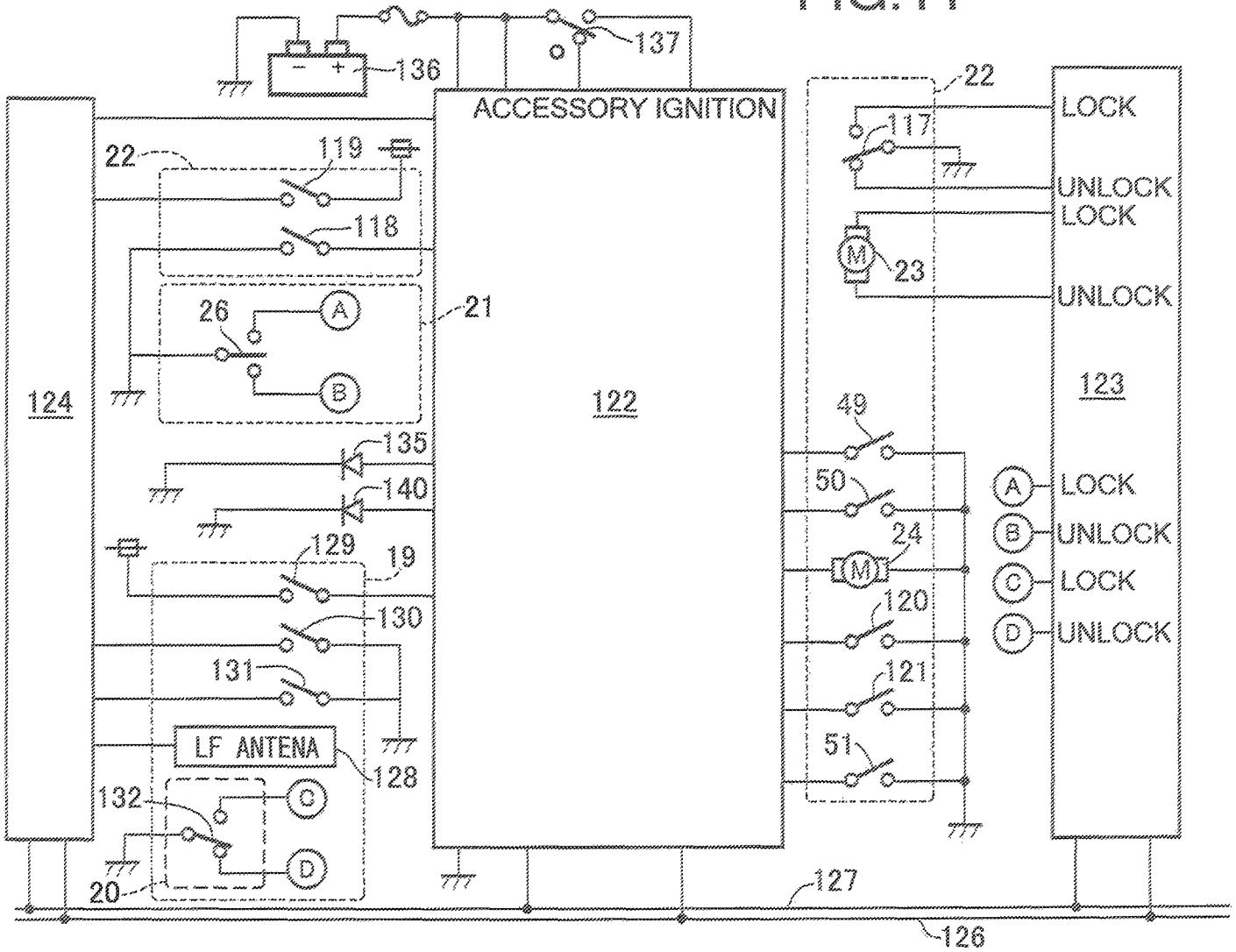
FIG. 11 is a diagram showing the arrangement of a control system. (first embodiment)

In FIG. 11, actuation of the latch release electric motor 24 is controlled by a latch control unit 122, actuation of the lock/unlock switching electric motor 23 is controlled by a central control unit 123, and the latch control unit 122 and the central control unit 123 are connected to a smart control unit 124 via a CAN-H line 126 and a CAN-L line 127.

Installed within the outside handle 19 is an LF antenna 128 for sending and receiving a signal to and from a portable apparatus carried by the vehicle user, disposed within the outside handle 19 are two unlock switches 129 and 130 that attain an ON state when a predetermined position of the outside handle 19 is gripped and a lock switch 131 that attains an ON state when another predetermined position of the outside handle 19 is gripped, and provided on the cylinder lock 20 attached to the outside handle 19 is a key switch 132 for detecting whether the cylinder lock 20 has been operated toward the lock side or the unlock side.

Inputted into the latch control unit 122 are ON/OFF signals from the unlatched switch 49, the fully-latched switch 50, the ratchet switch 51, the latch release intention detection switch 118, the initial position cam switch 120, and the ratchet release position cam switch 121, which are disposed within the casing 35 of the latch mechanism 22, and the unlock switch 129.

Connected to the smart control unit 124 is the LF antenna 128, and inputted into the smart control unit 124 are ON/OFF signals from the latch release intention detection switch 119, which is disposed within the casing 35 of the latch mechanism 22, and from the unlock switch 130 and the lock switch 131, which are provided on the outside handle 19.

Inputted into the central control unit 123 are a signal showing which of the locked state and the unlocked state is being detected by the lock/unlock detection switch 117 disposed within the casing 35 of the latch mechanism 22, a signal showing in which of the locked state and the unlocked state the lock/unlock switching switch 26 provided on the inside handle 21 is being operated, and a signal showing to which of the lock side and the unlock side the key switch 132 attached to the cylinder lock 20 is being operated.

When the front side door D is closed and in the locked state, if a vehicle user grips the outside handle 19 and the unlock switches 129 and 130 attain an ON state, sending and receiving of an ID signal are carried out wirelessly between the portable apparatus carried by the vehicle user and the LF antenna 128; if it is confirmed by the ID signal that the vehicle user is legitimate, the lock/unlock switching electric motor 23 actuates and attains the unlocked state, and in the unlocked state the latch release electric motor 24 actuates and releases the latched state.

The reason why the two unlock switches 129 and 130 are provided on the outside handle 19 is for imparting redundancy in the same manner as for the two latch release intention detection switches 118 and 119 disposed on the latch mechanism 22; when a single unlock switch is used, the switch could for example automatically turn ON due to a system failure, and the latch release electric motor 24 would be undesirably actuated, but providing the two unlock switches 129 and 130 as described above enables undesirable actuation of the latch release electric motor 24 to be prevented.

The latch control unit 122 controls energization of one light-emitting diode 135 as electric display means for displaying by energization that the latch mechanism 22 is in the unlocked state, based on the output from at least the lock/unlock detection switch 117; power from a battery 136 is supplied to the latch control unit 122, and power from the battery 136 is also supplied to the smart control unit 124 via the latch control unit 122.

The light-emitting diode 135 is disposed on the inner face side of the front side door D such that the light-emitting diode 135 is visible from the outside of the vehicle when the front side door D is in the closed state, and in this embodiment as shown in FIG. 1 the light-emitting diode 135 is disposed in a lower edge part of a window 138 of the inner face of the front side door D.

Furthermore, in FIG. 1, an engine switch 137 is disposed on a dashboard 139 disposed in a front part within the vehicle compartment 17, the engine switch 137 being a switch pushed by the driver seated on the driver's seat 18 so as to switch between a power source OFF state in which energization of in-vehicle equipment that is activated by energization is cut off and a power source ON state in which energization of the in-vehicle equipment is enabled. The engine switch 137 can switch between a state in which energization of accessories mounted on the vehicle is enabled and an ignition coil of an engine is energized, a state in which energization of the accessories is enabled but energization of the ignition coil is cut off, and a state in which energization of the accessories and the ignition coil is cut off, and this engine switch 137 is disposed between the battery 136 and the latch control unit 122 as shown in FIG. 11.

When the engine switch 137 is in the switching mode in which energization of the accessories is enabled and the ignition coil of the engine is energized an ignition terminal of the latch control unit 122 is electrically connected to the battery 136, and when the engine switch 137 is in the switching mode in which energization of the accessories is enabled but energization of the ignition coil is cut off an accessory terminal of the latch control unit 122 is electrically connected to the battery 136; the latch control unit 122 determines that a state in which either the ignition terminal or the accessory terminal is electrically connected to the battery 136 is a power source ON state and determines that a state in which both the ignition terminal and the accessory terminal are cut off from the battery 136 is a power source OFF state.

Furthermore, after the latch release electric motor 24 starts actuation so as to pivot the ratchet 41 from the ratchet engagement position to the ratchet release position, the latch control unit 122 stops actuation of the latch release electric motor 24 when the ratchet release position cam switch 121 detects a predetermined pivoting position for the cam 71 corresponding to the ratchet release position for the ratchet 41; after a predetermined stop time, for example five seconds, has elapsed after the actuation stopping, the latch release electric motor 24 is actuated so as to pivot the ratchet 41 to the ratchet engagement position.

Control of such actuation of the latch release electric motor 24 is explained by reference to FIG. 12; at a time t1 when the fully-latched switch 50 is in the ON state in a fully-latched state in which the ratchet 41 is engaged with the latch 40 when the front side door D is completely closed, if the latch release intention detection switches 118 and 119 detect a latch release intention of the vehicle driver, the latch release electric motor 24 actuates so as to pivot the ratchet 41 toward the ratchet release position side, the latched state is released by pivoting of the ratchet 41 in response to the actuation of the latch release electric motor 24, and due to the ratchet 41 pivoting toward the ratchet release position side the switching mode of the ratchet switch 51 switches from an ON state to an OFF state. At time t2 when the latch 40, which has been urged in the door opening direction, is slightly pivoted due to the latched state being released, the fully-latched switch 50 attains an OFF state, the ratchet release cam switch 121 attains the ON state at the subsequent time t3, in response thereto actuation of the latch release electric motor 24 stops, and the ratchet 41 is maintained at the ratchet release position.

At a time t4 when a predetermined stop time T1, for example five seconds, has elapsed after the latch release electric motor 24 has stopped, the latch release electric motor 24 starts actuating so as to pivot the ratchet 41 toward the ratchet engagement position side, after the ratchet release position cam switch 121 turns OFF at a time t5 accompanying actuation of the latch release electric motor 24 and when the initial position cam switch 120 in the OFF state attains an ON state for a short time and then attains an OFF state at a time t6, actuation of the latch release electric motor 24 is stopped, and the switching mode of the ratchet switch 51 switches from an OFF state to an ON state.

Whereas an actuation time T2 of the latch release electric motor 24 in order to pivot the ratchet 41 from the ratchet engagement position to the ratchet release position is for example 0.07 seconds, an actuation time T3 of the latch release electric motor 24 in order to pivot the ratchet 41 from the ratchet release position to the ratchet engagement position is for example 0.12 seconds, and thus T2<T3. Actuation of the latch release electric motor 24 when pivoting from the ratchet engagement position to the ratchet release position is stopped in response to the ratchet release position cam switch 121 turning ON, whereas the setting is such that actuation of the latch release electric motor 24 when pivoting the ratchet 41 from the ratchet release position to the ratchet engagement position is stopped in response to the initial position cam switch 120 in the OFF state attaining the ON state for a short time and then the OFF state, and when maintaining the ratchet 41 at the ratchet engagement position the initial position cam switch 120 is prevented from being continuously in the ON state and wasting power.

Figure 12:
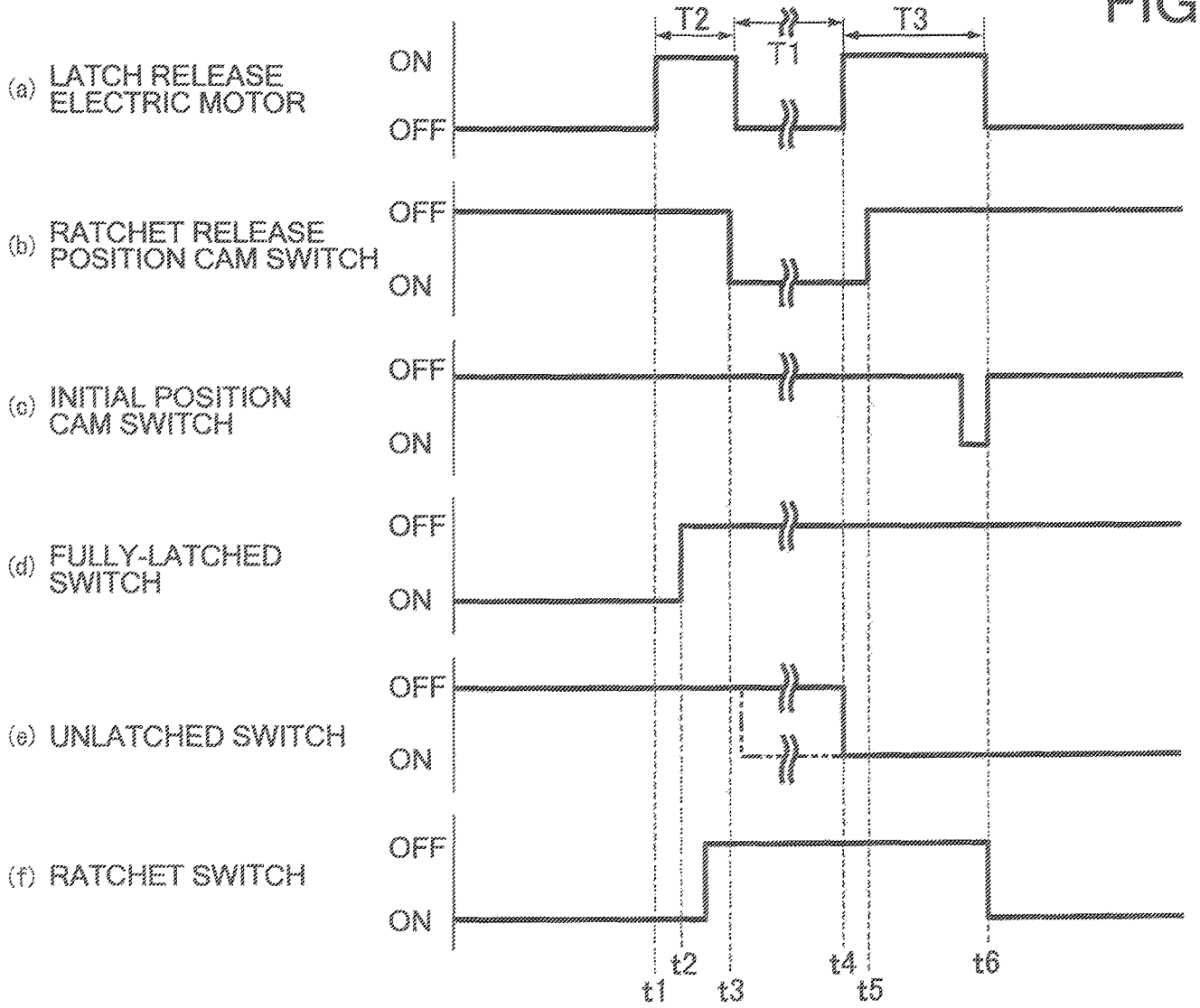
FIG. 12 is a timing chart for explaining actuation control of the latch release electric motor. (first embodiment)

Furthermore, when as shown by the chain line of FIG. 12 the unlatched switch 49 detects that the front side door D has pivoted from the closed position toward the open side after the latch release electric motor 24 starts actuation so as to pivot the ratchet 41 from the ratchet engagement position to the ratchet release position and before the predetermined stop time T1 has elapsed after the ratchet release position cam switch 121 detects that the ratchet 41 is at the ratchet release position and actuation of the latch release electric motor 24 has stopped, the latch control unit 122 immediately actuates the latch release electric motor 24 so as to pivot the ratchet 41 toward the ratchet engagement position side even partway through the passage of the predetermined stop time T1.

Figure 13:
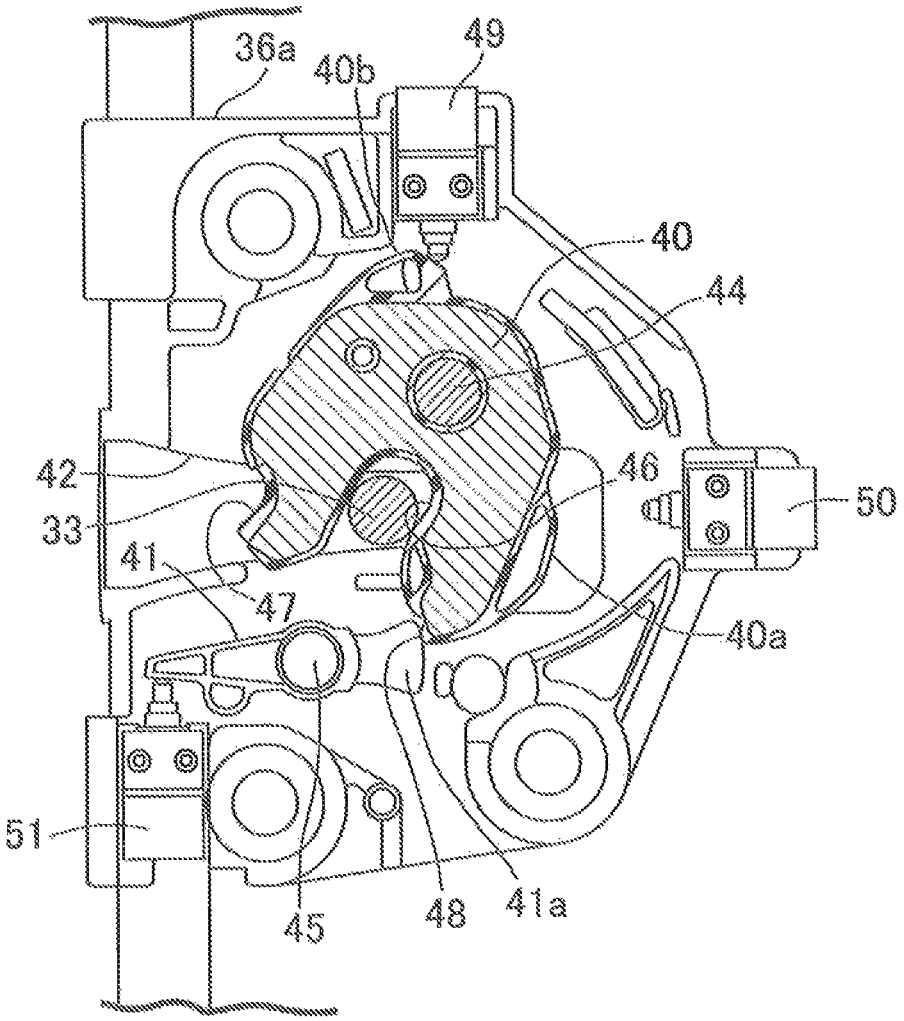
FIG. 13 is a sectional view, corresponding to FIG. 5, in a state in which the ratchet has stopped before fully reaching the ratchet engagement position due to a malfunction. (first embodiment)

When the ratchet 41 moves from the ratchet release position to the ratchet engagement position, there is a possibility that it will stop before fully reaching the ratchet engagement position due to a malfunction caused by deterioration of the transmission means 53 or the ratchet 41. In that case, engagement of the ratchet 41 with the latch 40 becomes insufficient when the front side door D is closed; as shown in FIG. 13 there is a half-shut state in which the ratchet 41 slightly engages with the half engagement step part 48 of the latch 40, or there is a state in which the ratchet 41 slightly engages with the full engagement step part 47 of the latch 40, and there is a possibility that the problem of the front side door D not being able to be maintained in a fully closed state will occur.

Therefore, the latch control unit 122 determines that there is an abnormality based on the switching mode of the ratchet switch 51, which is the first switch and which detects whether or not the ratchet 41 is in the ratchet engagement position, the switching mode of the initial position cam switch 120, which is the second switch and which is provided separately from the ratchet switch 51 and detects that the transmission means 53 has operated until the ratchet 41 attains the ratchet engagement position based on the operating position of the cam 71, which is an operating member forming part of the transmission means 53, and the switching mode of the ratchet release position cam switch 121, which is the third switch and which is provided separately from the ratchet switch 51 and the initial position cam switch 120 and detects that the transmission means 53 has operated until the ratchet 41 attains the ratchet release position based on the operating position of the cam 71.

Figure 14:
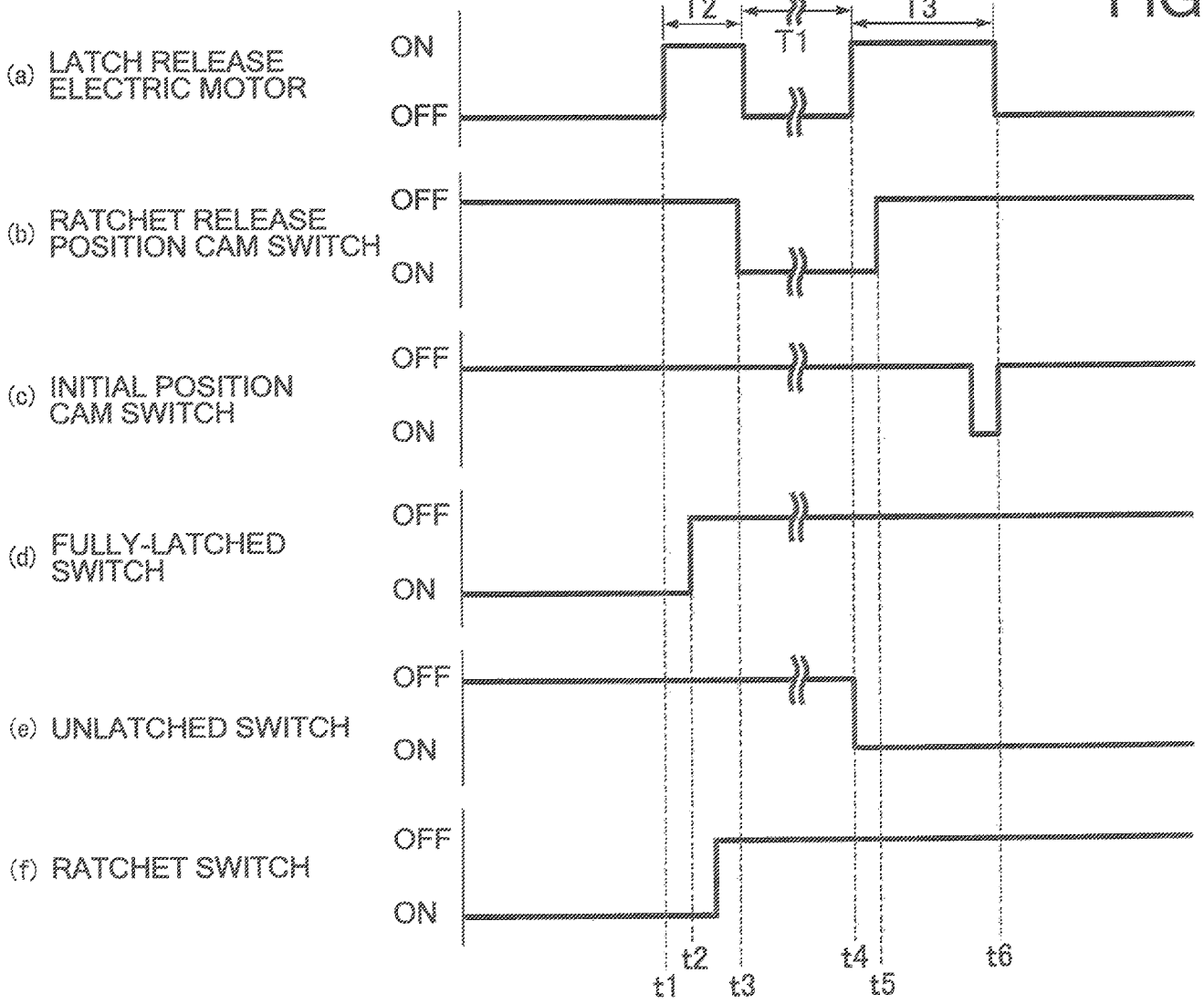
FIG. 14 is a timing chart, corresponding to FIG. 12, in the state shown in FIG. 13. (first embodiment)

Here, if it is assumed that there is a malfunction in the transmission means 53 or the ratchet 41, as shown in FIG. 14 at time t6 when actuation of the latch release electric motor 24 to pivot the ratchet 41 to the ratchet engagement position stops, even if the initial position cam switch 120 switches the switching mode from the OFF state to the ON state for a short time and then to the OFF state, the ratchet switch 51 remains in the OFF state due to the ratchet 41 not pivoting to the ratchet engagement position; the latch control unit 122 shows that a failure of the ratchet switch 51, an abnormal operation of the transmission means 53, or an abnormal operation of the ratchet 41 has occurred when the switching mode of the ratchet switch 51 is unchanged when the switching mode of the initial position cam switch 120 has changed, and the latch control unit 122 determines that there is an abnormal state.

Figure 15:
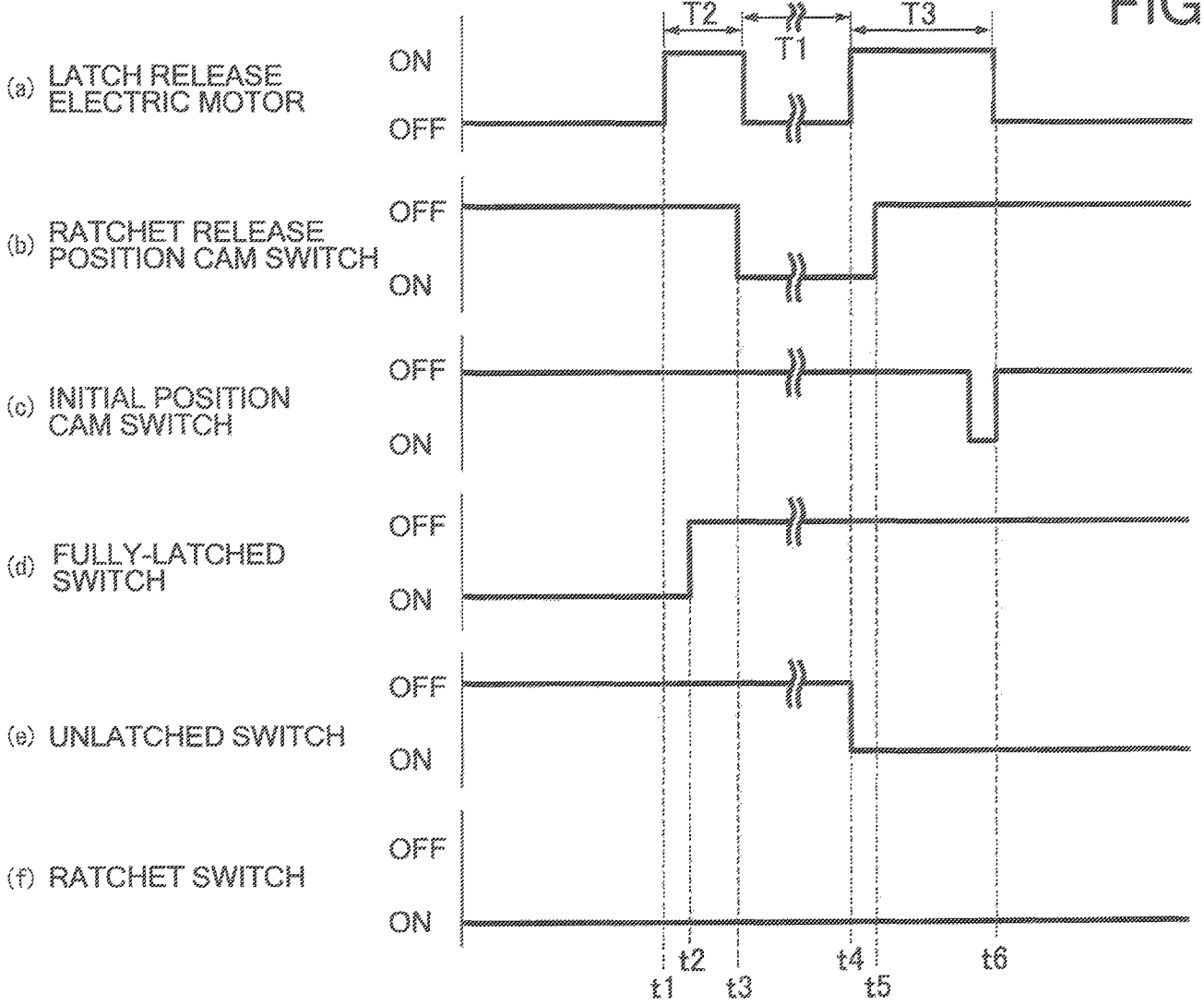
FIG. 15 is a timing chart, corresponding to FIG. 12, when a ratchet switch fails. (first embodiment)

Furthermore, when the ratchet switch 51 fails while it is in a switching mode that shows that the ratchet 41 is in the ratchet engagement position state, that is, while it is in the ON state, as shown in FIG. 15 at time t3 when the ratchet release position cam switch 121 detects that the transmission means 53 has operated so that the ratchet 41 pivots to the ratchet release position, the ratchet switch 51 remains in the ON state, and in such a state the latch control unit 122 determines that the ratchet switch 51 has failed while remaining in the ON state. That is, when the ratchet switch 51 fails while remaining in the ON state, the failure state is determined at time t3, which is an earlier timing than time t6.

Moreover, as shown in FIG. 11, the latch control unit 122 has connected thereto a warning light 140, which is a light-emitting diode, as abnormality notification means, and the latch control unit 122 controls the turning ON and OFF of the warning light 140 so as to carry out notification by flashing the warning light 140 in response to determination of an abnormal state.

The warning light 140 may be provided in a middle part of the lock/unlock switching switch 26 disposed on a face of the front support portion 21*b* of the inside handle 21 that faces the interior of the vehicle compartment as shown in FIG. 3, or as shown by the chain line in FIG. 1 it may be provided on an instrument panel of the dashboard 139.

The operation of the embodiment is now explained; the ratchet switch 51 detects whether or not the ratchet 41 is in the ratchet engagement position, the initial position cam switch 120 detects, based on the operating position of the cam 71 forming part of the transmission means 53, that the transmission means 53 has operated until the ratchet 51 attains the ratchet engagement position, and the latch control unit 122, which controls actuation of the latch release electric motor 24, determines that there is an abnormal state when the switching mode of the ratchet switch 51 is unchanged when the switching mode of the initial position cam switch 120 changes. That is, even though the switching mode of the initial position cam switch 120 has changed in response to the ratchet 41 moving to the ratchet engagement position, if the switching mode of the ratchet switch 51, which detects whether or not the ratchet 41 is in the ratchet engagement position, does not change, this suggests that a failure of the ratchet switch 51, an abnormal operation of the transmission means 53, or an abnormal operation of the ratchet 41 has occurred, and such an abnormal state can be determined by the latch control unit 122.

Furthermore, since the ratchet release position cam switch 121 detects that the transmission means 53 has operated until the ratchet 51 attains the ratchet release position based on the operating position of the cam 71, which forms part of the transmission means 53, and the latch control unit 122, which controls actuation of the latch release electric motor 24, determines that the ratchet switch 51 has failed when the ratchet switch 51 is in the switching mode that shows that the ratchet 41 is in the ratchet engagement position state when the switching mode of the ratchet release position cam switch 121 changes, it is possible to determine that the ratchet switch 51 has failed with earlier timing than when the switching mode of the initial position cam switch 120 is switched, based on the switching mode of the ratchet release position cam switch 121 being switched earlier than the initial position cam switch 120 when driving the ratchet 41 so that it goes from the ratchet engagement position through the ratchet release position and returns to the ratchet engagement position.

Moreover, since in response to the latch control unit 122 determining that there is an abnormal state the warning light 140 flashes to thus carry out notification of the abnormal state, it is possible to prevent the occurrence of a situation in which engagement of the ratchet 41 with the latch 40 is released by vibration while the vehicle is traveling.

Moreover, when the unlatched switch 49 detects that the front side door D has pivoted to the open side before the predetermined stop time T1 has elapsed since the ratchet release position cam switch 121 has detected that the ratchet 41 is at the ratchet release position and actuation of the latch release electric motor 24 has been stopped, the latch control unit 122 immediately actuates the latch release electric motor 24 so as to pivot the ratchet 41 toward the ratchet engagement position side. Because of this, if the ratchet 41 were at the ratchet release position when the front side door D had closed (quickly closed) before the predetermined stop time T1 had elapsed after the latched state had been released and the front side door D had been opened, the front side door D could not be maintained in the closed state, but even when the front side door D is quickly closed the ratchet 41 can be made to engage with the latch 40, thus maintaining the closed state of the front side door D.

An embodiment of the present invention is explained above, but the present invention is not limited to the above embodiment and may be modified in a variety of ways as long as the modifications do not depart from the spirit and scope thereof.

The invention claimed is:

1. A vehicle door latch control device comprising:

a latch that, in response to pivoting of a door to a closed side thereof, engages with a striker on a vehicle body side, the latch having an engagement groove formed therein for receiving the striker, and being pivotally movable between an open state, a half-shut state and a completely closed state thereof, a ratchet having an engagement arm portion that is operable to selectively and releasably fix a position of the latch, wherein the ratchet is pivotally movable between a ratchet engagement position, in which selective engagement with the latch in the completely closed state or in the half-shut state is enabled, and a ratchet release position in which engagement with the latch is released, an electric actuator that exerts power for driving the ratchet between the ratchet engagement position and the ratchet release position, a power transmission mechanism that is provided between the electric actuator and the ratchet and configured to put the ratchet in the ratchet release position in a mode in which the electric actuator is not being actuated, and a control unit that controls actuation of the electric actuator, wherein the device further comprises:

a first switch configured to be contacted by an end of the ratchet opposite the engagement arm portion, the first switch operable to detect whether or not the ratchet is in the ratchet engagement position, and a second switch that is provided separately from the first switch, and that is operable to detect that the transmission means has operated until the ratchet attains the ratchet engagement position, based on an operating position of an operating member of the power transmission mechanism, wherein the control unit is operable to determine that there is an abnormal state when a switching mode of the first switch is unchanged at a time that the second switch changes switching mode.

2. A vehicle door latch control device comprising:

a latch that, in response to pivoting of a door to a closed side thereof, engages with a striker on a vehicle body side, the latch being pivotally movable between an open state, a half-shut state and a completely closed state thereof, a ratchet that operates between a ratchet engagement position, in which selective engagement with the latch in the completely closed state or in the half-shut state is enabled, and a ratchet release position in which engagement with the latch is released, an electric actuator that exerts power for driving the ratchet between the ratchet engagement position and the ratchet release position, a power transmission mechanism provided between the electric actuator and the ratchet and configured to put the ratchet in the ratchet release position in a mode in which the electric actuator is not being actuated, and a control unit that controls actuation of the electric actuator, wherein the device further comprises:

a first switch that is operable to detect whether or not the ratchet is in the ratchet engagement position, a second switch that is provided separately from the first switch, and that is operable to detect that the ratchet attains the ratchet engagement position, based on an operating position of an operating member of the power transmission mechanism, and a third switch that is provided separately from the first and second switches and that is operable to detect that the ratchet attains the ratchet release position, based on the operating position of the operating member, wherein the control unit is operable to determine that there is an abnormal state when a switching mode of the first switch is unchanged at a time that the second switch changes switching mode, and wherein the control unit is operable to determine that the first switch has failed when the first switch is in a switching mode, showing that the ratchet is in the ratchet engagement position state, at a time that the third switch changes switching mode.

3. The vehicle door latch control device according to claim 1, comprising abnormality notification means that carries out notification in response to the control unit determining that there is said abnormal state.

4. The vehicle door latch control device according to claim 2, comprising abnormality notification means that carries out notification in response to the control unit determining that there is said abnormal state.

* * * * *